United States Patent [19]

Cantu

[11] Patent Number: 4,784,283

[45] Date of Patent: Nov. 15, 1988

[54] SELF-CLOSING BEVERAGE CAN

[76] Inventor: Paul Cantu, 4012 Tod Ave., East Chicago, Ind. 46312

[21] Appl. No.: 146,588

[22] Filed: Jan. 21, 1988

[51] Int. Cl.[4] ..... B65D 41/32

[52] U.S. Cl. ..... 220/269; 220/90.4

[58] Field of Search ..... 220/270, 90.2, 90.4, 220/254, 268, 269

[56] References Cited

U.S. PATENT DOCUMENTS

| | | | |
|---|---|---|---|
| 4,113,135 | 9/1978 | Yamazaki | 220/90.4 X |
| 4,190,174 | 2/1980 | Haimowitz | 220/90.4 X |
| 4,215,794 | 8/1980 | Lewis et al. | 220/270 |

*Primary Examiner*—Donald F. Norton
*Attorney, Agent, or Firm*—Richard G. Kinney

[57] ABSTRACT

A metal beverage can having an easy opening top provided with a scored or otherwise weakened line defining a flap opening. An opening structure or member is secured to the can top at flap area and serves to aid in tearing or splitting the top along the scored or weakened line to form the flap and also serves, thereafter, to push down the flap when the can is raised to the lips of a user such that the opening member makes contact with the user's upper lip. The top of the can is concave and the opening structure is so arranged as to provide a "stop" to prevent the flap from being pushed too far into the can interior. The flap when forward and free of the curved top is constructed so that it straightens to extend the forward lip of the flap so that it serves as a "stop" to prevent, in normal service, the flap from rising above the surface of the top. The flap is resiliently biased toward that position and resiliently returns to it after it is pushed down as by the lips of a user.

14 Claims, 1 Drawing Sheet

SELF-CLOSING BEVERAGE CAN

FIELD OF THE INVENTION

The present invention is directed toward a new and improved easy opening beverage can.

BACKGROUND OF THE INVENTION

Metal beverage cans have been commercially available equipped with easy opening facilities. Pull tabs and the like are now standard on such cans. U.S. Pat. No. 4,559,729 issued to R. G. White depicts and describes one common commercial tab structure.

Other examples of easy open can tops are described in U.S. Pat. Nos. 3,952,914; 3,738,526; 3,335,058 and 3,364,937.

While lip-opening covers made of thin plastic and the like have been suggested for coffee cup lids (e.g. U.S. Pat. No's. 4,113,155 and 4,190,174) such have not been successfully or practically incorporated into metal can tops due to the different problems and requirements for such cans. For example, cans must be made to resist accidental opening during storage, shipping or handling. The disposable plastic coffee cup type covers need not be similarly so concerned. Also the metal can's contents are often under internal pressure especially when they contain a carbonated beverage such as beer and most soft drinks and consequently a pressure proof closure must be provided. Again, coffee and tea cup covers are not concerned with that problem.

SUMMARY OF THE INVENTION

A beverage can constructed in accordance with the present invention includes a top of thin metal which terminates in a rim. The top is weakened along a generally U-shaped line to define, when ruptured along that line, a flap. The flap's open or free end, is adjacent the rim and its fixed end is spaced inward so that when pivoted downward the flap provides an easy pouring opening. Unlike most conventional cans, however, the flap does not remain depressed in the can's interior, nor is it removed, but instead the flap is constructed to spring back upward to approximately the level of the can top so as to substantially re-close the top. Means forming an upward projecting lip-contacting member are provided so that the upper lip of one bringing the can up to his or her lips serves to depress or pivot the flap into the can and provide a free flowing pour opening. When removed from the lips the flap springs back to substantially close the opening.

The invention, together with other advantages thereof, may best be understood by reference to the following description taken in connection with the accompanying drawings, in the several figures of which, like reference numerals identify like elements.

DETAILED DESCRIPTION

Figure 1:
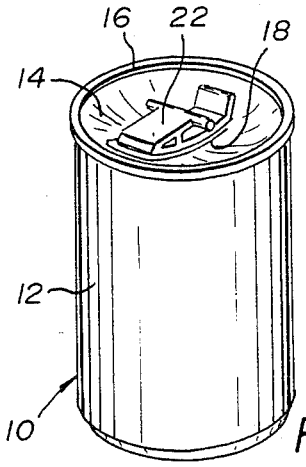
FIG. 1 is a perspective view of a beverage can constructed in accordance with the present invention.

Referring to FIG. 1 there is depicted a beverage can 10 constructed in accordance with the present invention. The can 10 has a hollow bottom portion 12 and, in accordance with one feature of the present invention is provided with a concave top 14. The top 14 terminates in a round rim 16 which is sealed to the bottom of portion 12 (the top 14 is usually sealed to the bottom 12 after filling of the latter with a beverage).

Figure 2:
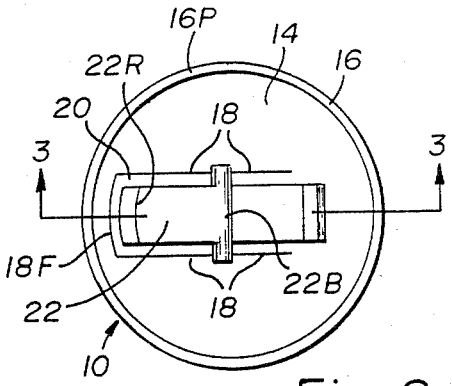
FIG. 2 is a top view of the can of FIG. 1.

As best shown in FIG. 2 the top 14 is, as initially formed and while the can is shipped and stored, provided with a generally U-shaped weakened line 18. It is well known and conventional in this art how such lines may be formed. This line 18 has an arc portion 18F adjacent one portion of the rim 16P and preferably has two straight and parallel portions which run generally away from that rim portion 16P to end a distance away. An opening structure or member 22 is provided attached to the area surrounded by the line 18.

Figure 3:
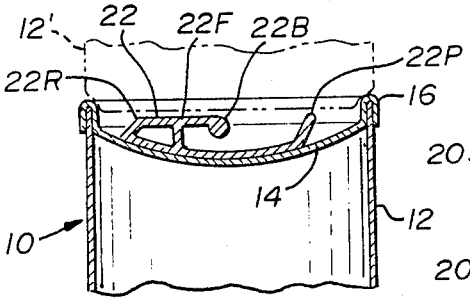
FIG. 3 is a sectional partial view of the can of FIGS. 1 and 2 as seen from the plane deferred by the line 3—3 of FIG. 2 when looking in the direction of the arrows associated with line 3—3, with a portion of a second similar can shown in phantom outline stacked atop the can.

As best shown in FIG. 3, the member 22 is constructed to provide its highest projection, a flat surface 22F and a lever projection 22P, which project up no higher than the rim 16 and preferably slightly below it so that the bottom 12′ of a similar can may be stacked atop of the can 12.

The member 22 does not just serve to aid in stacking, however, but also aids in opening the can 10. That is, the member 22 has a stop bar 22B which is formed on a horizontal projection so as to allow a finger to be placed under it while a thumb of the same hand is pressed at a front ridge 22R and a third finger presses upward and forward on the projection 22P. When this is done and force applied a rocking distortion of the can top occurs. This stresses the can top along the line portion 18F to cause it to rupture. Continual pressure and movement of the member 22 propagates the rupturing along the side portions of the line 18. Note, however, from FIG. 2 that the bar 22B projects beyond the line 18 and thus serves as a "stop" when the member and the flap 20 is depressed into the interior of the can 10. This contact or stopped position is shown in FIG. 4 in solid lines.

Figure 4:
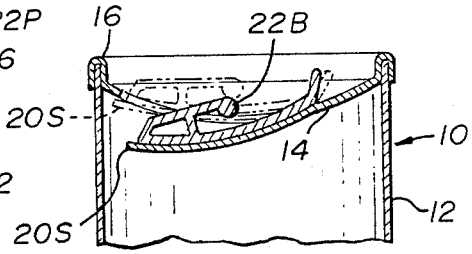
FIG. 4 is a view similar to that of FIG. 3 but with some parts shown in a one moved position in solid lines and in another moved position in dashed lines.

In accordance with one major feature of the present invention the flap 20—member 22 structure is spring biased so that it, when released (from the position shown in solid lines in FIG. 4) springs or moves back to the position shown in dashed lines in FIG. 4. This may be done by making the can top of spring metal (such as 0.009 inch thick stainless steel) or by making the member 22 of resilient material and securing it so as to pull up the flap, or otherwise. The essential point is to bias the flap 20 and member 22 slightly so that they naturally tend to return upward as shown in FIG. 4. (The strength of this spring bias need not be great and should be such that after upturning it to form the flap 22 a slight pressure downward on member 22 will pivot it down.)

As also shown in FIG. 4, a stop 20S is preferably incorporated so as to prevent the flap 20 from being easily drawn out of the can. This stop 20S is preferably formed by making the flap 20 not only of spring material but also such that it tends to, when released by the rupturing of line 18, straighten out or be less curved than before. That extends the lip of the flap 20 so that it contacts the under surface of the top 14 along the line portion 18F (FIG. 2). This can be achieved by securing the member 22 under tension to the flap 20 at longitudinally spaced positions such that when the line 18 is ruptured the member 22 deforms slightly to straighten out or decrease the curvature of the flap 20.

Figure 5:
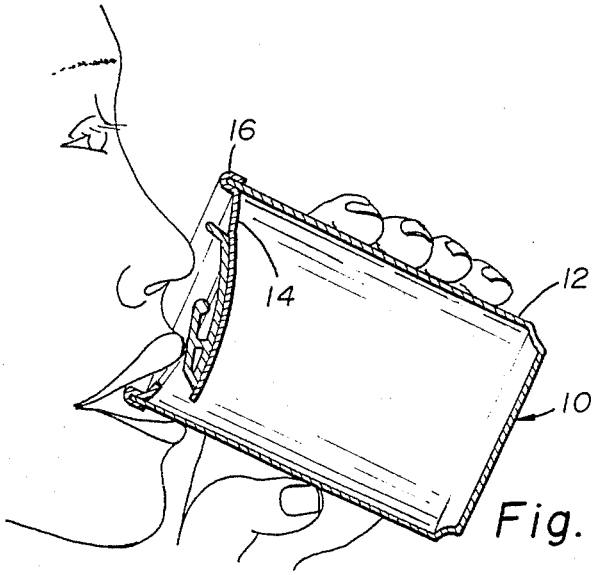
FIG. 5 is a sectional view of the can of FIGS. 1-4 shown in use by a person whose lips are shown depressing the portion of the opened can top to provide a free flowing pour opening.

The construction of the can 10 allows the can, once opened, to be used as shown in FIG. 5. That is it allows the flap 20 to be opened by lip pressure.

While the returned flap 20 does not absolutely seal the opening along the line 18, it is sufficiently closed so as to prevent any great spillage from occurring in a short period of time should a once-opened can be tipped over and, more importantly, prevents insects, such as bees, from entering the opened can when set aside for a short time.

Also, if desired, a seal member, e.g. a flexible plastic projection pre-secured to the flap 20 but having a flat unsecured projection beyond and about the flap 20 so as to underlay and project beyond the line 18, may be provided. In this case the flap 18 need not and preferably would not become less curved than it was prior to rupturing along line 18.

Thus while one particular embodiment of the invention has been shown and described, it will be obvious to those skilled in the art that changes and modifications may be made without departing from the invention, and, therefore, the aim in the appended claims is to cover all such changes and modifications as fall within the true spirit and scope of the invention.

I claim:

1. A metal beverage can having a top metal wall with means defining a weakened line thereon, which line is shaped in the outline of a flap, and which line substantially surrounds and defines a flap area of the top metal wall and extends to be adjacent one edge of the can top and which, when the weakened line is ruptured, forms a flap which can pivotally move downward into the interior of the can so as to provide a pour opening;

an opening structure mounted atop said top and serving to allow rupturing forces to be applied to said weakened line, said structure being mounted to said top so as to extend over said flap area;

said flap when formed after said line is ruptured being resiliently pivoted so as to, when pivotally depressed within said can below said top, return under spring bias to said area; and said structure mounted atop said flap being so configured as to present a smooth surface above the flap which surface is sized and shaped to contact with the lip of a user of the can who brings the can top to his or her lips with the flap opening near the mouth and in response to such contact to resiliently pivot the flap after it is depressed, downward into the can so as to open the pour opening and allow the user to drink from the can.

2. A beverage can comprising a bottom and a top of thin metal terminating in a rim, secured to said bottom;

said top being weakened along a generally U-shaped line to define a flap and a pour-opening when said top is ruptured along said U-shaped line, said flap having a fixed end and a moving end and said pour opening defined adjacent one portion of said rim and the fixed end being spaced away from that one portion of said rim so that the flap, when formed, may pivot or bend inward into the can to provide the free flow pour opening;

said can top being so constructed that said flap when formed and when pushed so as to bend or pivot inward is biased to spring upward and does return upward when released after being depressed to approximately the location of said top; and means providing a lip-pushing projection above said flap for contacting the lip of a user who raises the can to his or her mouth which contact may push said moving end of said flap, when formed, inward to open the pour opening for free pouring from the can.

3. The beverage can of claim 2 wherein said top is concave in shape and said projection means is positioned on said concave top so that said can can receive other cans stacked atop it without said projection means interfering with a stacked atop can.

4. The beverage can of claim 3 wherein means for providing a stop are provided on said top for stopping the flap's upward return movement at about said top so it, when formed and not subjected to outside forces, substantially closes the pour opening;

5. The can of claim 4 wherein said stop means are provided by having said U-shaped flap defined on said top such that prior to rupturing along the U-shaped line the flap is curved between its free end and its fixed end, and means are provided to lessen the curvature of said flap after being forced by rupturing along said line so that the free end may contact the underside of said top when it rises upward to substantially close the pour opening.

6. The beverage can of claim 3 wherein said projection means includes a stop which, when said moving end is pushed inward, limits the inward movement.

7. The beverage can of claim 6 said flap is made of resilent spring-like material.

8. The beverage can of claim 7 wherein said flap, prior to rupturing along said line is curved at one rate of curvature and said projection means is a separate unit attached to said flap and said top in such a manner as to decrease its curvature and extend said moving end of said flap so that it forms a stop for stopping said flap's upward return movement at about said top.

9. The beverage can of claim 7 wherein said projection means is a separate unit and includes a leverage projection which may aid in the manual rupturing along said line.

10. The beverage can so defined in claim 7 wherein said flap area of the metal can top is prior to rupturing of the weakened line, at least in part, curved which curve, after rupturing, straightens out somewhat so as to extend portions of the edge of said flap under the edge of the top from which it has been ruptured so as to form said stop.

11. The beverage can of claim 2 wherein said flap is made of resilent spring-like material.

12. A beverage can top for a can having a bottom comprising:

a thin metal wall for forming the top, which wall has a top side and bottom side and peripheral rim area for securing to the bottom of the can to form a closed container;

a weakened rupture line formed in said wall in a generally U-shape to define a flap area, which area, when said metal wall is ruptured along said U-shaped line, forms a flap;

an opening member secured to said metal wall at the top side thereof atop said flap area, said member being coupled to the flap when formed such that a slight force pressing downward on the opening member pivots the formed flap downward to provide an opening;

said opening member further including means defining a stop for preventing said opening member from being easily pressed and moved entirely through said opening; and spring bias means provided for spring biasing upward said flap and opening member when depressed, such bias being such as to restore the flap to approximately the level of the rupture line in said wall and substantially close said opening when downward force on the opening member is removed.

13. The can top of claim 12 wherein a second stop means are provided whereby said flap and opening member are stopped and prevented from easily rising upward beyond approximately the level of said metal wall.

14. The can top of claim 13 wherein said metal wall is concave and has a peripheral area and said opening member extends no higher than approximately the level of the peripheral area of said concave wall so as to allow for easy stacking of a can on top of said beverage can top.

* * * * *